US008602956B2

(12) United States Patent
Monti

(10) Patent No.: US 8,602,956 B2
(45) Date of Patent: Dec. 10, 2013

(54) DEVICE FOR OPENING OUT BLANKS SUPPLIED IN A FLATTENED TUBULAR CONFIGURATION

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 169 days.

(21) Appl. No.: 13/240,518

(22) Filed: Sep. 22, 2011

(65) Prior Publication Data

US 2012/0094818 A1 Apr. 19, 2012

(30) Foreign Application Priority Data

Oct. 14, 2010 (IT) ..... BO2010A0612

(51) Int. Cl.
*B31B 5/80* (2006.01)

(52) U.S. Cl.
USPC ..... 493/314; 493/309; 493/315; 493/318; 53/564; 53/566

(58) Field of Classification Search
USPC ..... 493/309, 313, 314, 315, 318; 53/457, 53/458, 564, 566
See application file for complete search history.

(56) References Cited

U.S. PATENT DOCUMENTS 4,194,442 A * 3/1980 Martelli ..... 493/316
4,881,934 A * 11/1989 Harston et al. ..... 493/315
5,061,231 A * 10/1991 Dietrich et al. ..... 493/315
5,562,581 A * 10/1996 Roberto et al. ..... 493/310
5,715,657 A * 2/1998 Mondani et al. ..... 53/457
6,179,004 B1 * 1/2001 Davis, Jr. ..... 137/625.21
2007/0072756 A1 * 3/2007 Monti ..... 493/309
2007/0257416 A1 * 11/2007 Ford ..... 271/91
2008/0312058 A1 * 12/2008 Monti ..... 493/316

FOREIGN PATENT DOCUMENTS

FR 2478576 A 9/1981
GB 846891 A 8/1960
GB 2053133 A 2/1981

OTHER PUBLICATIONS

European Search Report for EP 2441688, Dated Jan. 24, 2012, 3 pages.

* cited by examiner

*Primary Examiner* — Alexandra Elve
*Assistant Examiner* — Adam Moon
(74) *Attorney, Agent, or Firm* — William J. Sapone; Ware Fressola Maguire & Barber LLP

(57) ABSTRACT

A device for opening out blanks supplied in a flattened tubular configuration comprises a store (100) for containing a stack (P) of flattened tubular blanks, a first hooking device (200) for hooking a first flap (1A) of two external flaps (1A, 1B) of a base blank of the stack, and a drum (300) set in constant rotation, peripherally exhibiting angularly-equidistanced work stations (20). Each work station has a retaining apparatus (22) for receiving, from the first hooking device (200), the first external flap (1A), so as to position a score line (2A), connecting the two external flaps (1A, 1B) along an axis C parallel to the rotation axis (11) of the drum. A folding device (29) oscillates in a direction (R) which is opposite the rotation direction (F) of the drum, about the axis (C) so as to intercept the second external flap (1B).

10 Claims, 10 Drawing Sheets

DEVICE FOR OPENING OUT BLANKS SUPPLIED IN A FLATTENED TUBULAR CONFIGURATION

FIELD OF THE INVENTION

Devices are known for operating on blanks in a flattened tubular configuration (from which corresponding boxes are obtained), singly collected from a base of a stack located in a store, with the aim of "opening out" the blank, i.e. varying the configuration from flattened to tubular.

DESCRIPTION OF THE PRIOR ART

The technical sector to which the present invention relates concerns devices performing the above-described function, constituted by first means suitable for collecting the blank at the bottom of the stack with the aim of transferring it to an opening station realized in a rotating drum at a constant velocity (see document FR 2.478.576).

The above-described drum comprises a series of the stations, identical to one another and angularly equidistanced.

The first means are constituted by at least an arm which bears sucker aspirating means, oscillating with respect to an axis that is parallel to the drum, from a collecting position of the base blank of the stack to a release position of the blank in a corresponding station of the drum.

It is known that the central part of a blank 1 is constituted by four consecutive flaps 1A-1D connected by longitudinal score lines 2A-2D which constitute a same number of hinges (see FIG. 1).

The first means hook onto the flap 1A; the flap is hooked by retaining means, constituted by depression suckers, provided in the drum station, activated in phase relation with the deactivating of the first means.

The above-mentioned station comprises folding means 3 which, in phase relation with the rotation of the drum, oscillate in an opposite direction to the rotation direction of the drum, such as to intercept flap 1B (see FIG. 2), i.e. the flap 1B arranged downstream with respect to the flap 1A blocked to the retaining means 4; this causes rotation of the flap 1B with respect to the score 2A, by an angle which is at least 90° (FIGS. 3, 4).

The rotation axis 3A of the folding means 3 does not coincide with the scoring 2A which constitutes the rotation axis of the flap 1B with respect to the flap 1A; this causes dragging of the folding means 3 against the external surface of the flap 2B (as evidenced by FIGS. 2-4) as there is a relative velocity between the means 3 and the external surface.

The above aspect generates drawbacks, such as unwanted creasing and/or abrasions and/or tearing of the surface involved; as the device works at a higher productivity, it has been noticed that there appear deformations in the flap 1B caused by the folding means 3, and in some cases (for example the square section of the tubular configuration) the impossibility of opening out the blank, i.e. obtaining the above-mentioned tubular configuration thereof.

The above-described drawbacks generate a certain amount of waste.

As mentioned, the first means position the flap 1A, gripped thereby, in contact with the suckers of the retaining means.

The optimal exchange between the suckers of the first means and the suckers of the retaining means presupposes a zero relative velocity between the suckers: this is not attainable as the peripheral velocity of the suckers of the first means is zero, and therefore different from the peripheral velocity of the suckers of the retaining means.

The "exchange" therefore occurs with an impact of the flap 2A, engaged by the first means, against the suckers of the retaining means; in phase relation with this impact the first means are deactivated and the suckers of the retaining means are activated; the imperfect synchrony of these steps (deactivation on one side and activation on the other) causes tangential stresses on the external surface of the flap 2A.

This situation, negatively influenced by the increase in productivity of the group comprising the first means and the rotating drum, can lead to creasing and/or abrasions on the external surface of the flap 1A; this certainly constitutes a drawback.

SUMMARY OF THE INVENTION

The main aim of the invention is to disclose a device for acting on tubular blanks in a flattened configuration such as to define the corresponding tubular conformations thereof, all obtainable in the absence of creasing and/or abrasions and/or lacerations and/or deformations on the external surfaces of the blank.

A further aim of the invention is to provide a device conformed such as not to produce creasing and/or abrasions and/or tearing of the external surfaces of the blank during the act of transferring the blank from the store to the work station for defining the tubular conformation of the blank.

A further aim of the invention is to provide a device that satisfies the previous advantages independently of the shape of the blanks, and all in a functional and reliable way.

The main aim is attained with a device for opening out tubular blanks, associated to a containing store of a stack of tubular blanks in flattened configuration, the walls of which are mutually positioned such as to arrange the score lines of each blank connecting the two external flaps thereof on a reference plane, the device being of a type comprising: first hooking means of a first flap of the two external flaps of the base blank of the stack and for a subsequent transfer of the blank to a corresponding work station of a series of work stations realized peripherally in a drum, set in constant rotation, each work station being angularly equidistanced, each station being provided with retaining means of the first flap and folding means of the second flap of the two external flaps in a direction opposite a rotation direction of the drum; the device being characterized in that the first hooking means are conformed such as to define, on hooking of the first flap of the base blank of the stack, a predetermined distance between the first hooking means and the reference plane, and such as to position the score, consequently to the hooking of the first flap by the retaining means actuated in phase relation with a deactivation of the first hooking means, at a predetermined axis which is parallel to an axis of the drum and located downstream of the retaining means, and in that the folding means, via first activating means, are made to oscillate about the axis in the direction opposite the rotation direction of the drum.

The fact of realizing the folding means, which intercept the second flap, such that they rotate with respect to the axis defined by the hinge (score) of the second flap with the first flap hooked to the retaining means, brings about a null relative velocity between the folding means and the second flap; therefore there are neither dragging phenomena on the external surface of the second flap nor mechanical stresses thereon.

This advantageous aspect is valid for any blank format.

The absence of abrasions and/or creasing and/or tearing on the external surface of the first flap, independently of the format, derives from the fact that the arm rotatably supporting the first hooking means is hinged to the second structure along an axis that is coaxial to the axis of the drum, third activating means being included to set the arm in oscillation in outward runs in a same direction as the rotation direction of the drum, and in return runs, defining for the hooking means, during the outward run in the time interval centered on the release of the first flap by the hooking means and the hooking of the flap by the retaining means, a same velocity as the peripheral velocity of the means.

BRIEF DESCRIPTION OF THE DRAWINGS

Further characteristics of the invention will emerge from the following description, which refers to the tables of drawings, in which.

DESCRIPTION OF THE PREFERRED EMBODIMENTS

With reference to the figures, 100, 200 and 300 respectively denote a store containing a stack of blanks 1, first means for hooking the base blank of the stack and removing it from the stack, and a drum for opening out the blanks supplied thereto intermittently by means of the first hooking means.

Figure 1:
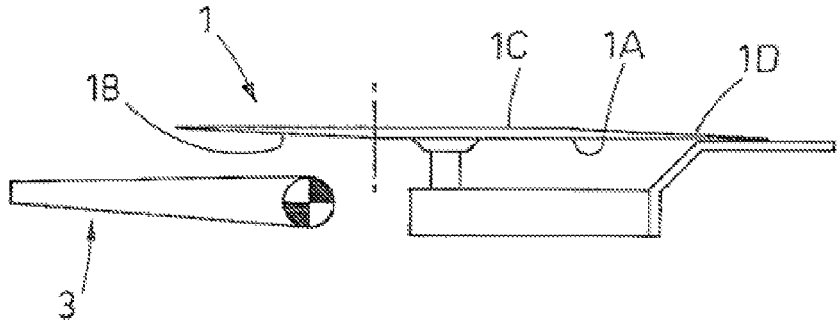
FIG. 1 Prior Art
FIGS. 1-4 schematically illustrate the opening out of a tubular blank as in the prior art.
Figure 2:
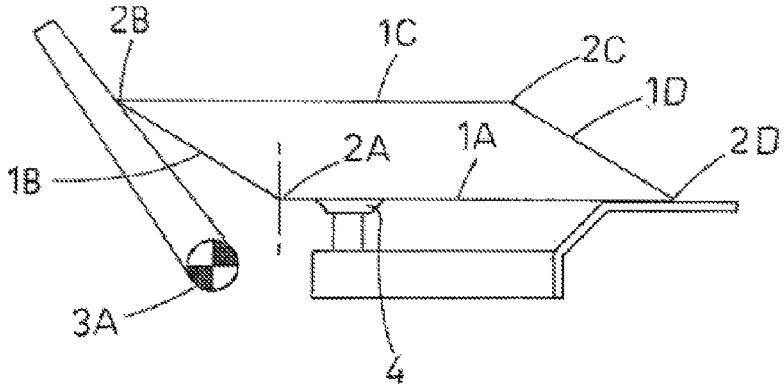
FIG. 2 Prior Art
Figure 3:
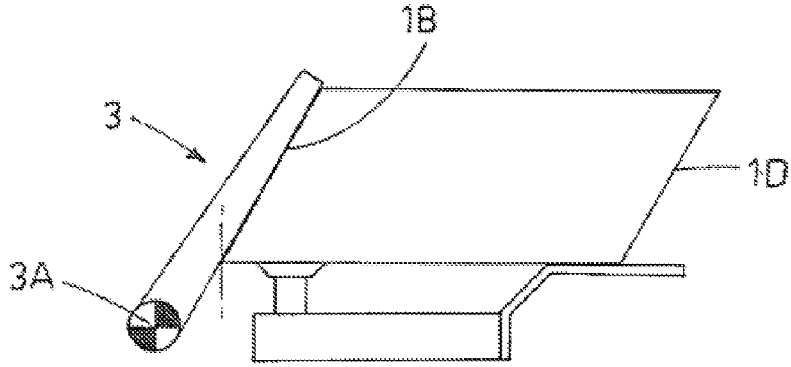
FIG. 3 Prior Art
Figure 4:
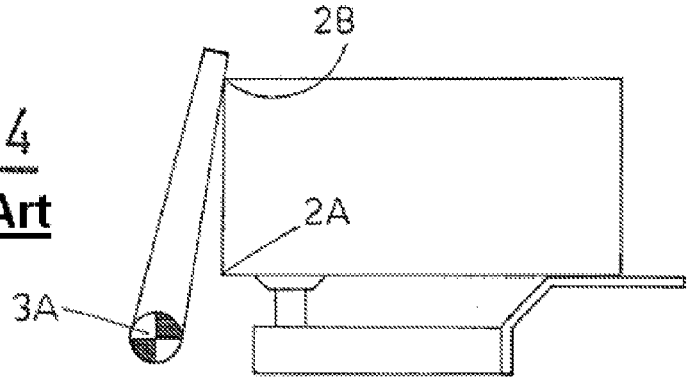
FIG. 4 Prior Art
Figure 5:
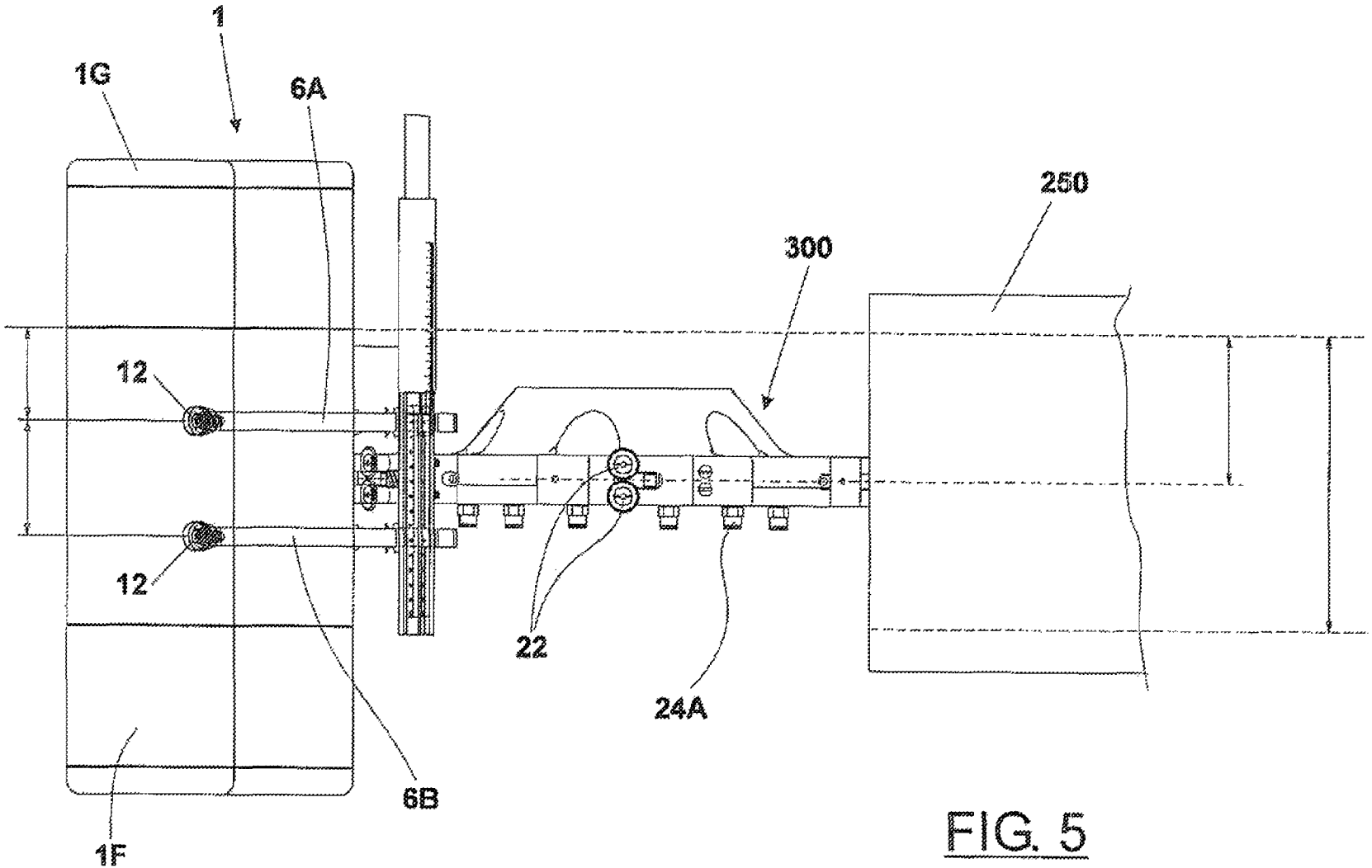
FIG. 5 schematically illustrates the device of the invention in a plan view.

As already mentioned, the blank is constituted by four flaps 1A-1D, of which two external flaps 1A, 1B and two internal flaps 1C, 1D, connected by scores 2A-2D; tabs 1F, 1G are hinged to the heads of the flaps (FIG. 5).

The walls 100A, 100B of the store are positioned such as to arrange the score 2A (the one connecting the external flaps 1A-1D) at a predetermined reference plane 7; it follows that on varying the format of the blanks the mutual distance between the walls 100A, 100B will consequently change with respect to the positioning of the score 2A on the plane 7.

The first hooking means 200 are constituted by two identical and parallel arms 6A, 6B borne by a shaft 8 rotatably supported by a bearing 9 borne in turn by an arm 10 which can oscillate with respect to an axis 11 that is coaxial to the rotation shaft of the drum 300; the shaft 8 is parallel to this axis (see FIGS. 1, 9-11).

The distance between the arms, which bear transfer suckers 12 at the ends that are connectable in a known way to a depression source, is greater than the thickness of the drum 300; further, the arms are positioned such as to be bilaterally arranged with respect to the heads of the drum 300 consequent to an oscillation thereof with respect to the axis of the relative shaft 8.

The oscillation (directions H, K) is imposed by means of a lever 112 constituted by an arm 13 splined on the shaft 8, a tie rod 14 connecting the shaft with an end of an arm 15 the remaining end of which is hinged to the structure S of the present device (FIG. 11); the arm 15 bears a roller 16 which engages with a closed-loop tract (not illustrated) realized in a disc 17 that rotates about a parallel axis to the axis 11.

A further closed-loop track (not illustrated) is realized on the disc 17 with which, when needed, a roller 18 borne by the arm 10 engages; this leads to oscillation thereof about the drum 300 axis, in outward and return runs (directions 1, and 12); the upper part of the arm 10 is conformed such as to engage with a fixed guide 19, with an arched development having a centre on the oscillation axis of the arm; this coupling stabilizes the arm during the relative oscillations.

The drum 300 includes stations 20 for opening out the blanks, which stations 20 are identical to one another and angularly equidistanced along the periphery of the drum 300.

Each station comprises a bar 21, fixed to the body 32 of the drum such as to be tangential to a circumference centered on the axis thereof.

The bar bears, on a side downstream of the rotating direction F of the drum, retaining means constituted, for example, by a pair of suckers 22 (connectable to a depression source, not illustrated), transversally flanked and located on a diameter plane of the drum; and on the opposite side a plate 23 the terminal part of which is coplanar to the suckers 22.

The station further comprises a cogged sector 24, with the axis 24A parallel to the axis of the drum, which enmeshes with a cog wheel 25 keyed on the shaft of a further cog wheel 26 (having a larger diameter than the other) in turn enmeshed with a portion of cogged crown 27 (which in the illustrated example develops over less than 180°) rotatably guided, and at the same time supported, by idle rollers 28 situated in front of the cog wheel 26 on an opposite side to the zone of mutual enmeshing between the cog wheel and the crown 27.

The rotation axis of the crown 27, denoted by C (FIG. 8) is situated downstream with respect to the suckers 22 and on the plane identified thereby; the distance between the axis C and the plane identified by the axes of the retaining suckers 22 is a predetermined distance d.

The crown 27 bears at an end thereof a folding means 29 orientated internally along a diameter plane of the crown which, consequently to the oscillation thereof, oscillates about the axis C.

The shaft 24A on which the cogged sector 24 is keyed exits from the body 32 of the drum; an arm 30 is perpendicularly blocked at the external end thereof, which arm 30 bears a roller 41; the roller 41 engages with a fixed cam, developing in a closed loop, having a profile such as to impose, in combination with the transmission ratios of the cogged sector 24—cog wheel 25, cog wheel 26—crown 27, an oscillation on the folding means in an operating direction R that is greater than 90°.

The functioning of the above-described device will now be illustrated.

As illustrated, independently of the format the score 2 of the base blank 1 of the stack P is aligned with the plane 7.

Figure 6A:
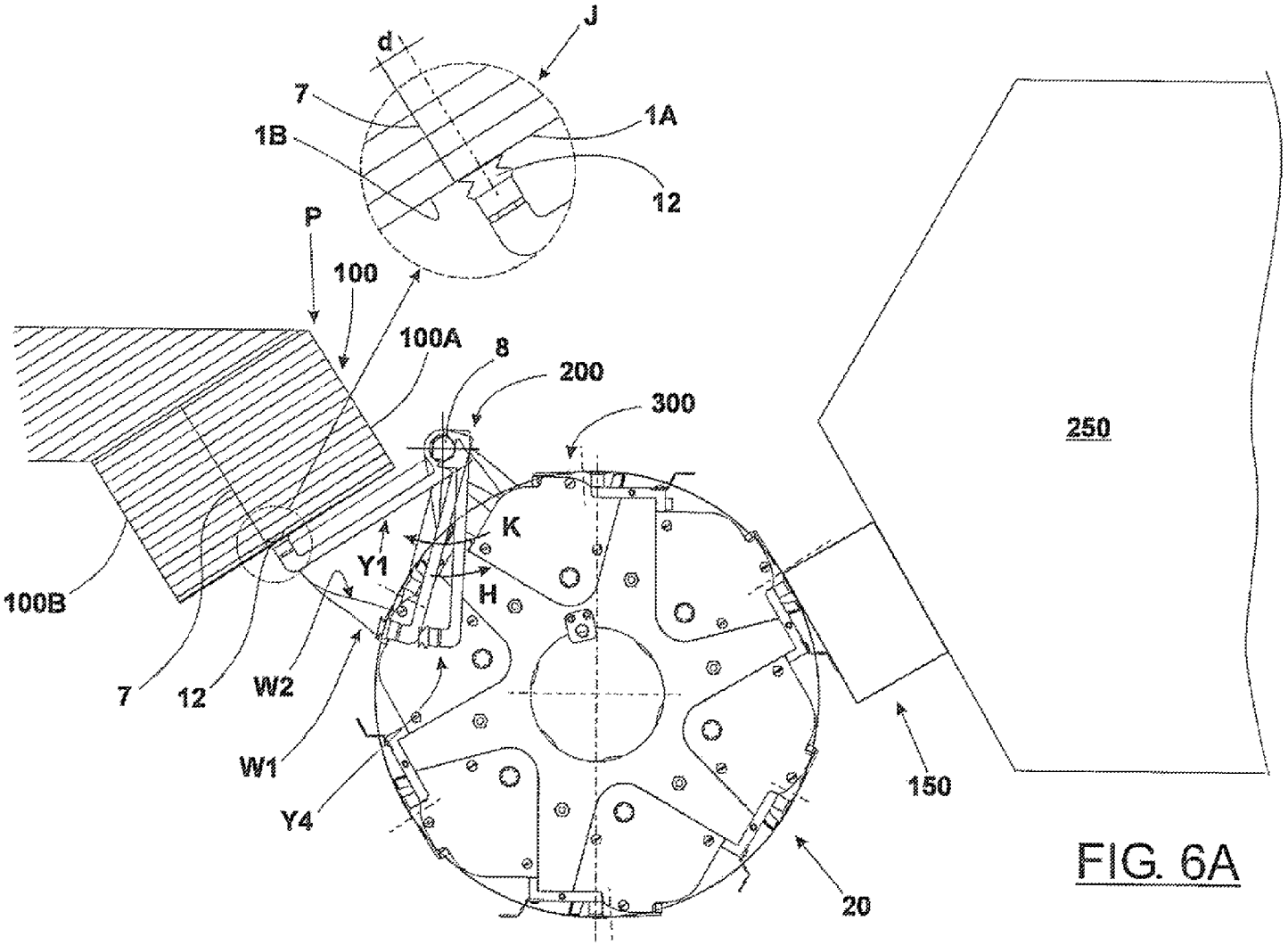
FIGS. 6A, 6B, 6C are frontal schematic views of the device of the invention.
Figure 6B:
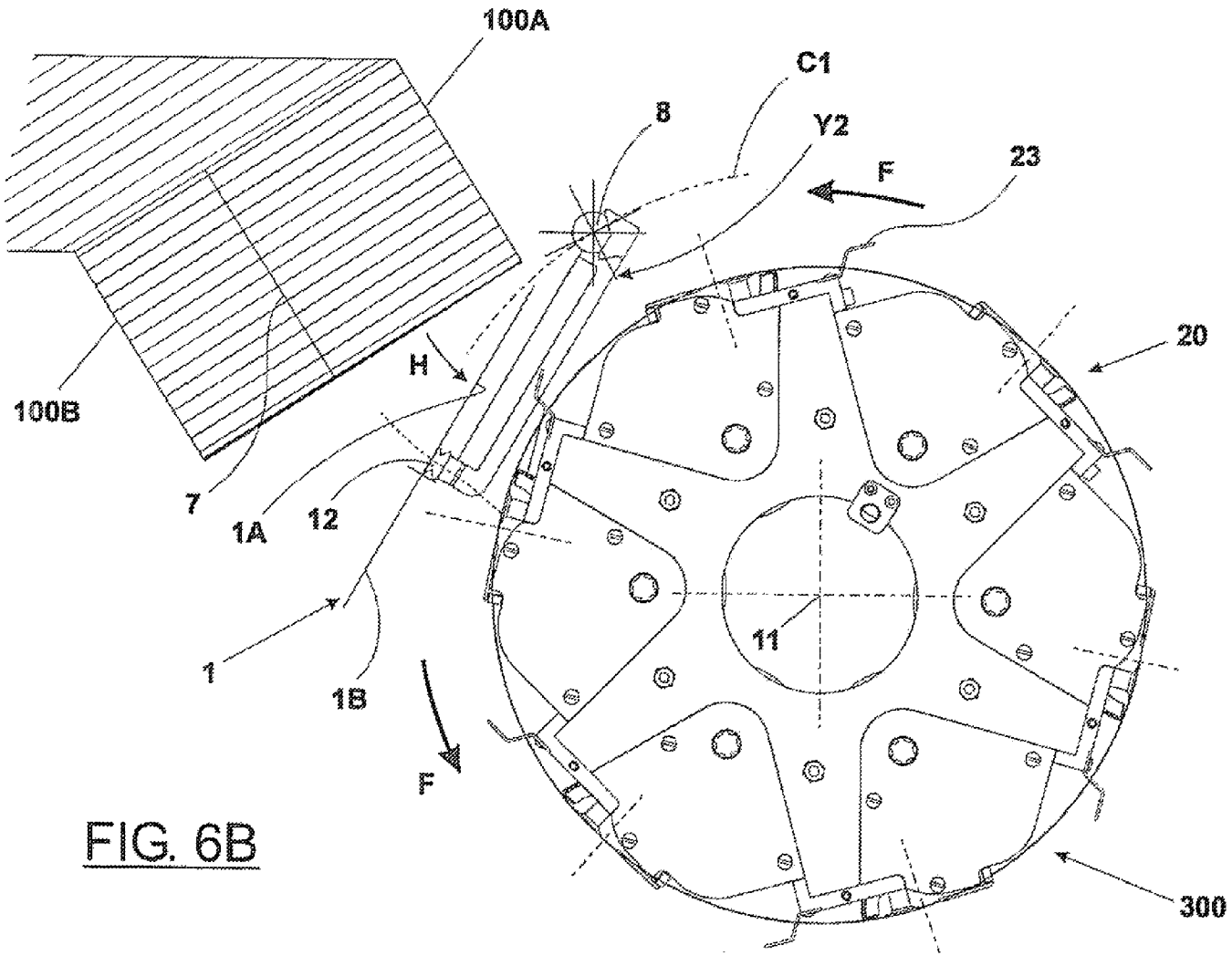
Figure 6C:
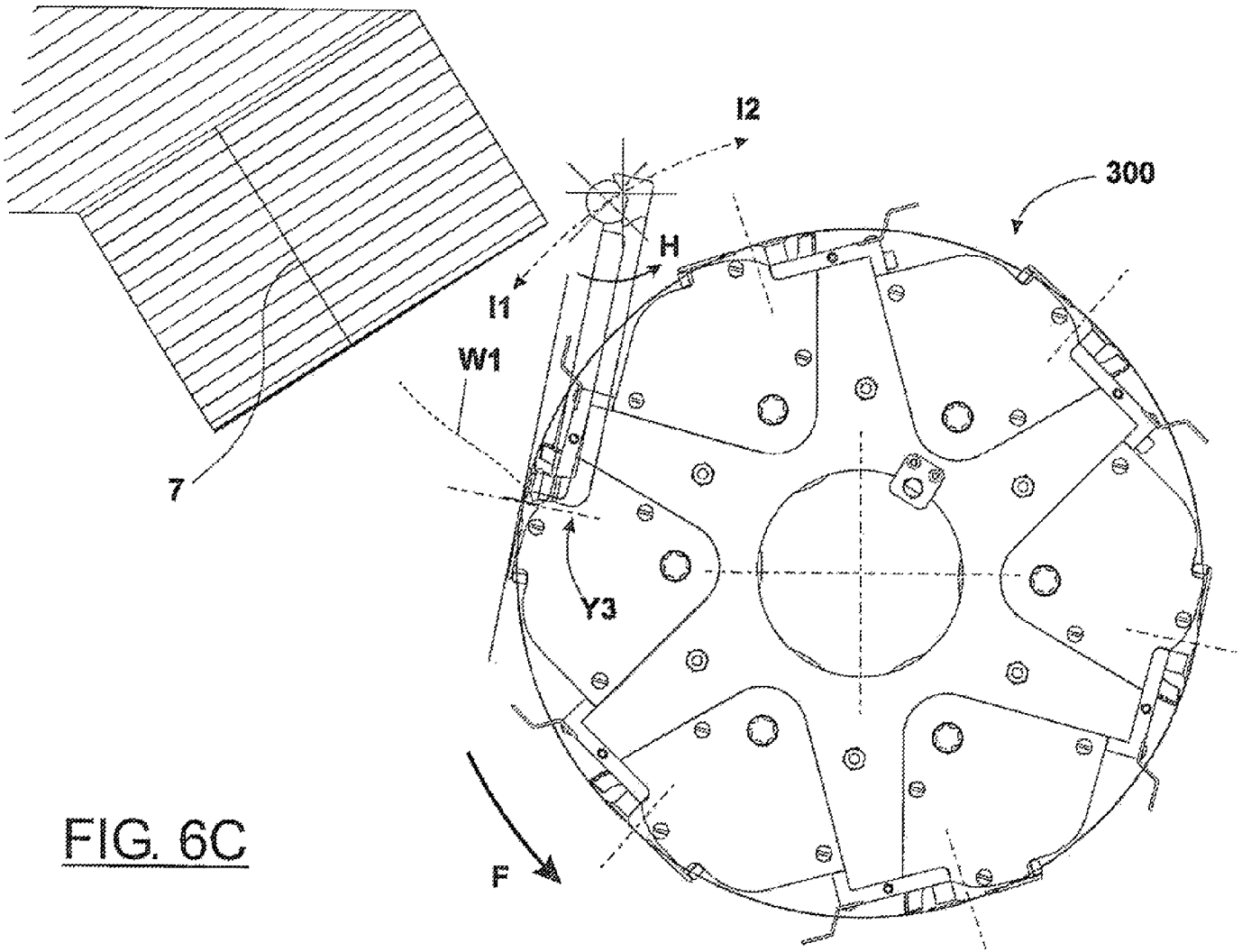
Figure 7:
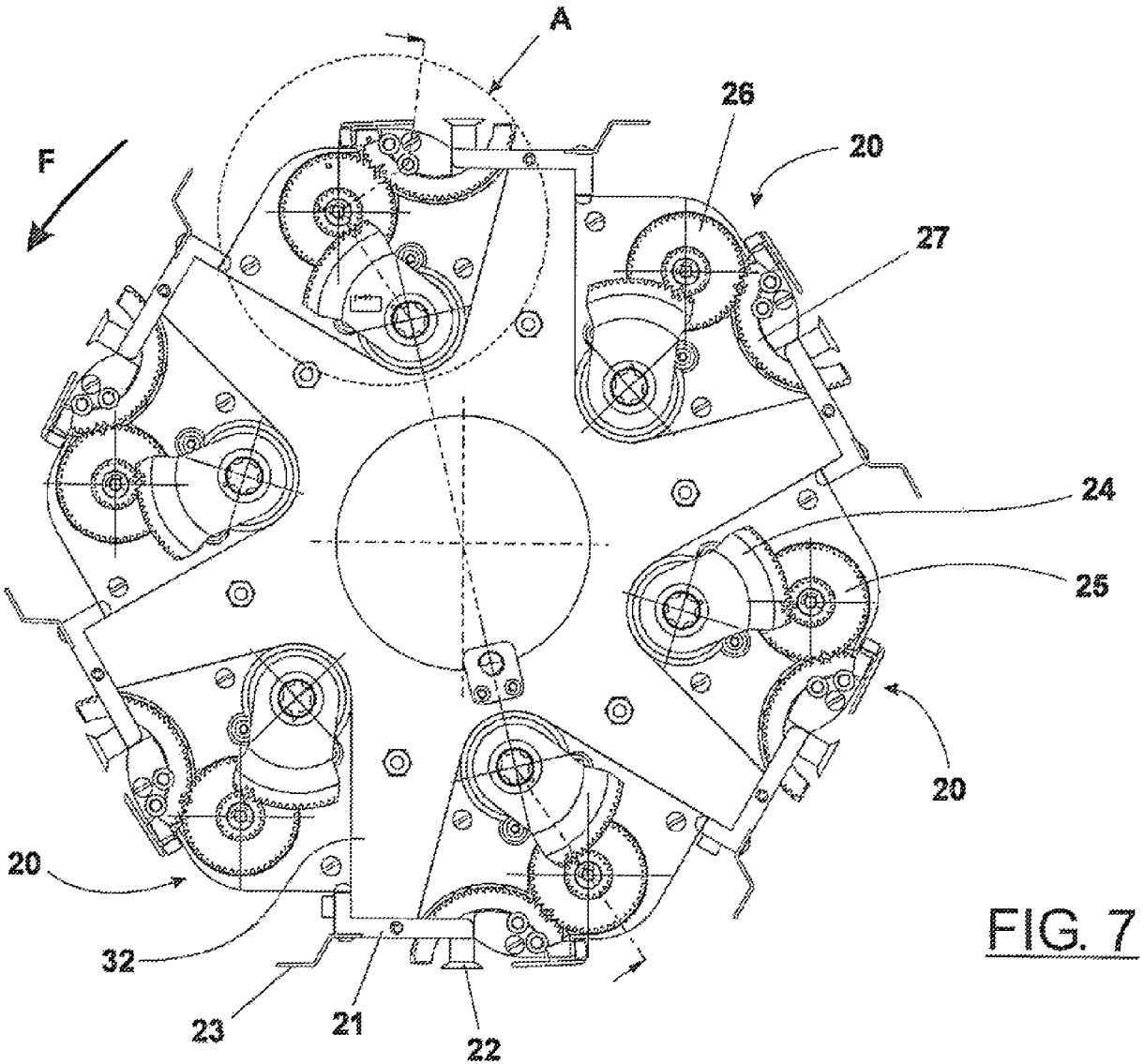
FIG. 7 is a frontal view of the drum of the device, with the various stations for the opening out of the blanks evidenced, as well as the means which in each station are designed for moving the relative folding means.

With reference to FIGS. 6A-6C various positions of the arms 6A, 6B have been indicated with respect to the group including the store 100—drum 300, denoted by $Y_1$ (FIG. 6A), $Y_2$ (FIG. 6B), $Y_3$ (FIGS. 6A, 6C), $Y_4$ (FIG. 6A).

In the first position $Y_1$, the transfer suckers 12 borne by the arms 6A, 6B intercept the first flap 1A of the two external flaps 1A, 1B of the base blank 1 of the stack P; the arms are conformed in such a way as to identify the predetermined distance d, between the reference plane 7 and the plane defined by the axes of the relative suckers 12.

The oscillation of the arms in the direction H causes the detachment of the base blank from the stack P which is transferred according to the path $W_1$: observe, by way of example, the second position $Y_2$.

The phase relation between the velocity of the drum 300 and the oscillation of the arms in the direction H is such as to lead to the transversal alignment between the transfer suckers 12 of the arms and the retaining suckers 22 of the corresponding station 20 when the flap 1A impacts against the said suckers.

In phase relation with this impact, the suckers 12 are deactivated and the suckers 22 are activated; this leads to the hooking of the suckers 22 to the first flap 1A of the blank (position $Y_3$).

As already evidenced, the mutual distance between the arms 6A, 6B enables the arms to position bilaterally with respect to the station 20; this technical aspect enables the transfer suckers 12 to deposit the first flap 1A on the retaining suckers 22.

After the disengagement of the transfer suckers 12 from the first flap 1A, the arms 6A, 6B continue their oscillation in the direction H up to reaching the end position $Y_4$ (FIG. 6A): this enables the space upstream of the arms 6A, 6B to be freed which, by inverting the oscillation thereof (direction K), return the suckers along the path indicated by $W_2$ to newly intercept the first flap 1A of the base blank of the stack P: thus a new transfer cycle of a blank 1 (in the flattened tubular conformation) commences, from the store 100 to a corresponding station 22 of the drum 300.

The proposed solution enables eliminating any eventual drawbacks deriving from the impact of the flap 1A on the suckers 22.

It is sufficient to set the arm 10 in oscillation on the outward run 11 and the return run 12: for this it is necessary to install the roller 18 on the arm such as to engage it with the relative cam realized on the disc 17.

This technical-functional aspect causes oscillation of the shaft 8 (on which the arms 6A, 6B are keyed) along an arc of circumference $C_1$ that are concentric to the axis 11 of the drum 300.

The conformation of the cam with which the roller 18 engages and the distance between the axes 8, 11 is such that during the course of the oscillation of the outward run 11 of the shaft 8, in direction F, the peripheral velocity of the transfer suckers 12 is equal to the peripheral velocity of the retaining suckers 22; this coincidence of velocities is certainly imposed at the moment of the transfer of the flap 1A from the transfer suckers 12 to the retaining suckers 22: coordination occurs between the arms 6A, 6B (which bear the suckers 12) and the station 20 (which bears the suckers 22).

This particular enables the flap 1A to be transferred (and therefore the blank 1) from the transfer suckers 12 to the retaining suckers 22 of the station 20, without any stresses on the external surface of the flap 1A itself.

During the return run the arm 10 (direction $I_2$), and at the same time as the oscillation of the arms 6A, 6B (direction K), the shaft 8 oscillates both in the opposite direction to the rotation direction F and with respect to its own axis in order to return to the start conditions of a new cycle.

As already mentioned in relation to the store 100, it is crucial to respect, for the score 2A of each blank, the positioning on the reference plane 7 independently of the format of the blank.

The foregoing involves maintaining the predetermined distance d (on varying the format) between the plane 7 and the axis of the transfer suckers 12 (see the enlarged detail J of FIG. 6A).

Each station 22 is realized such that the distance between the axis C of oscillation of the crown 27 and the axis of the suckers 22 is equal to distance d.

On transferring a blank 1 from the transfer suckers 12 of the arms 6A, 6B to the retaining suckers 22 of the station 20, the suckers 12 are arranged bilaterally to the retaining suckers 22 with respect to which they are transversally aligned.

When the first flap 1A impacts on the retaining suckers 22, the planes defined by the axes of the transfer suckers 12 and the retaining suckers 22 coincide: it follows that the score 2A of the blank 1, when the relative first flap 1A is hooked to the retaining suckers 22, is coaxial to the axis C, i.e. to the oscillation axis of the crown 27.

Following the hooking of the first flap 1A by the retaining suckers 22 and during the course of the rotation of the drum 300, the shaft 24A is set in oscillation, which leads to the oscillation of the crown 27 in direction Q.

The folding means 29 borne by the crown 27, when rotating about the centre C (operating run R) intercepts the second flap 1B of the two external flaps which, when hinged to the first flap 1A by means of the score 2A, also rotates about the axis C.

Figure 8:
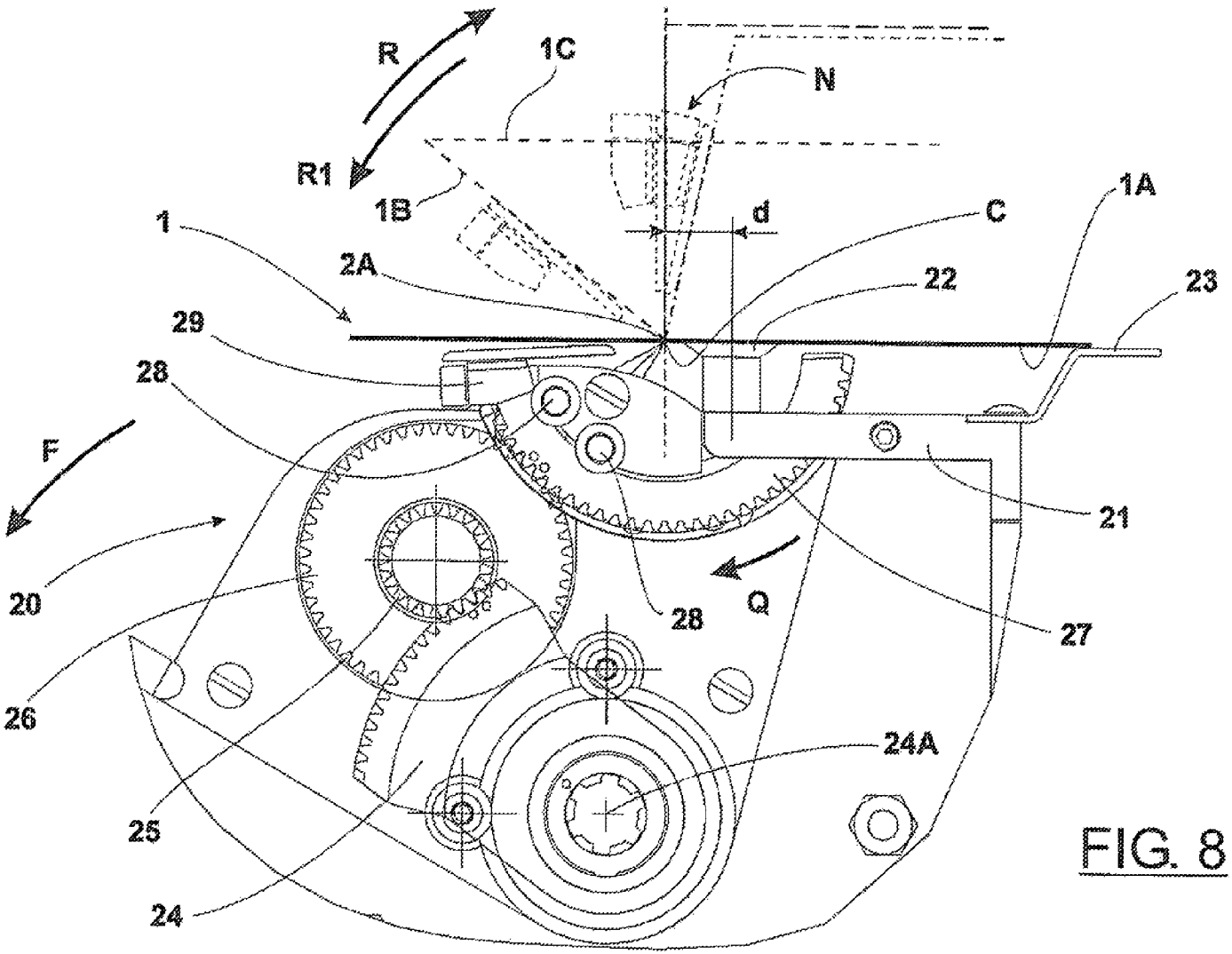
FIG. 8 is a larger-scale illustration of detail A of FIG. 7.
Figure 10:
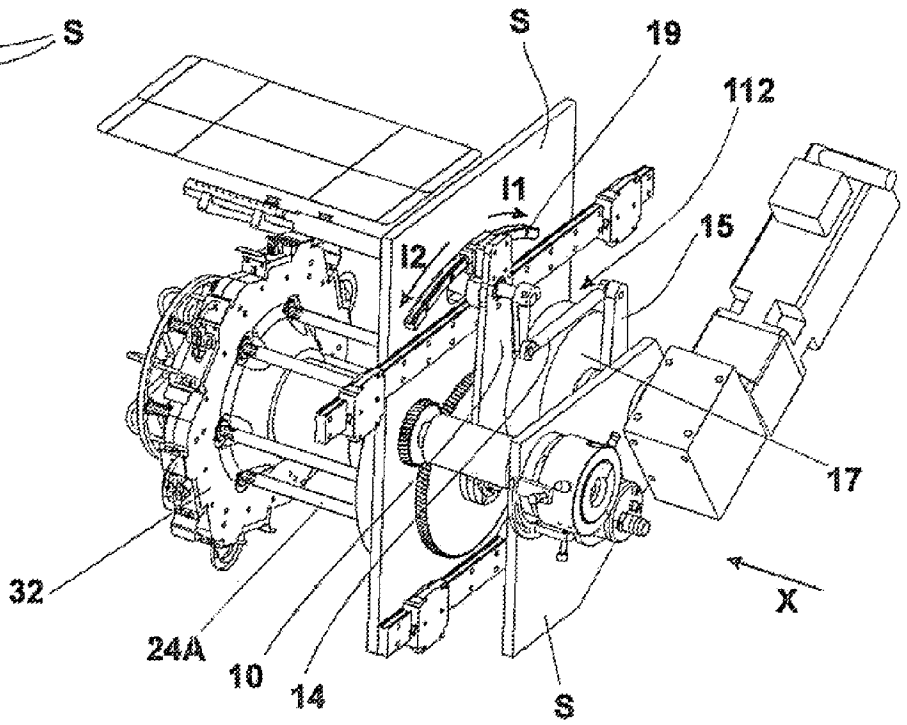
FIGS. 9, 10 illustrate perspective views, considered from different angles, of the means for transferring the blanks from the store to the drum.
Figure 9:
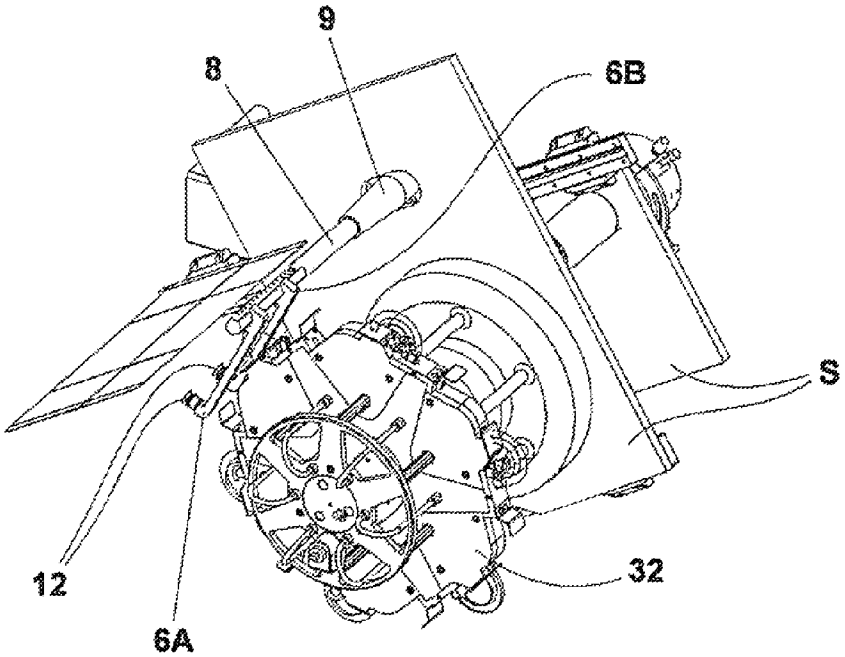
Figure 11:
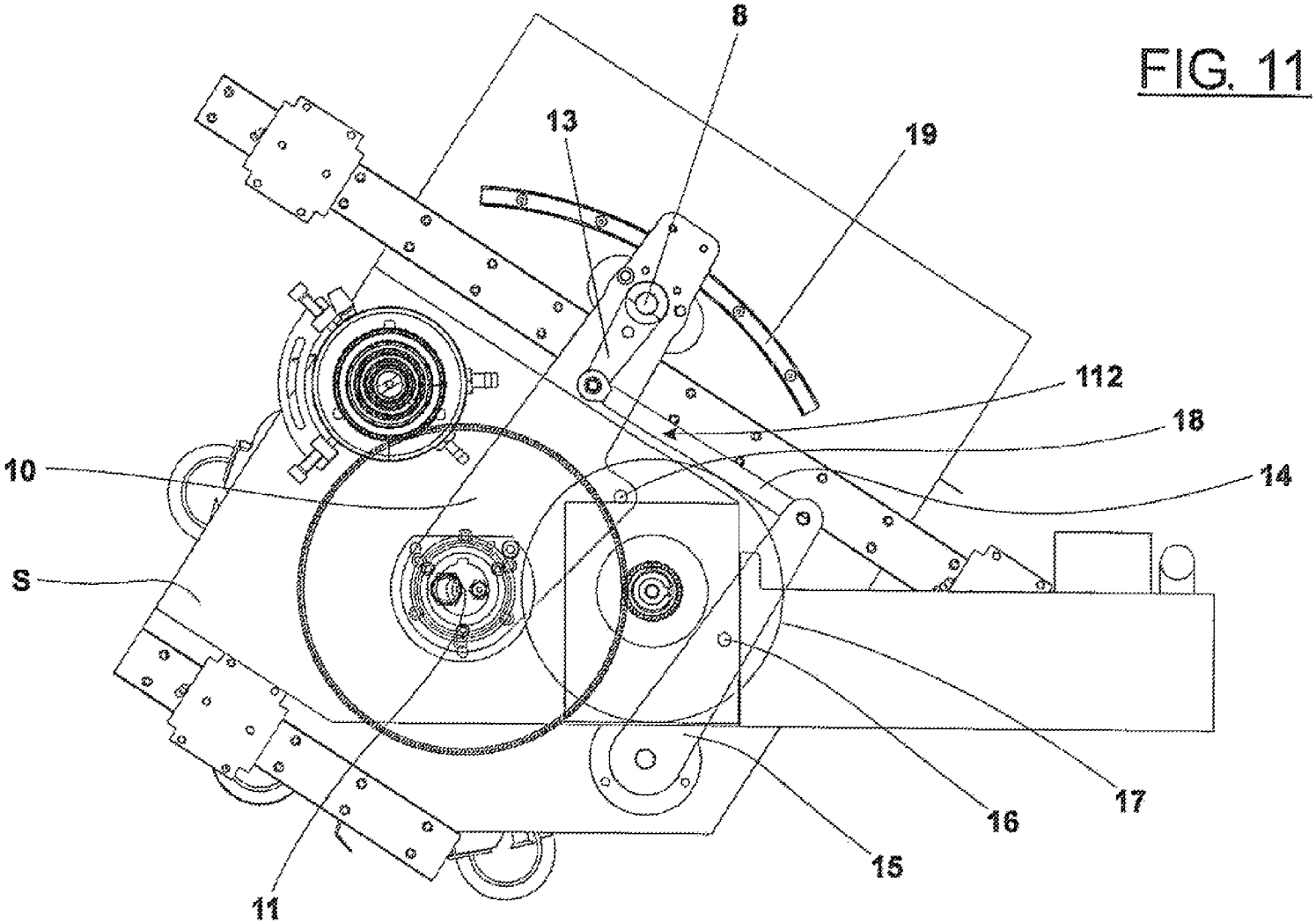
FIG. 11 is the view along arrow X of FIG. 10, with some parts removed better to evidence constructional aspects.
Figure 12:
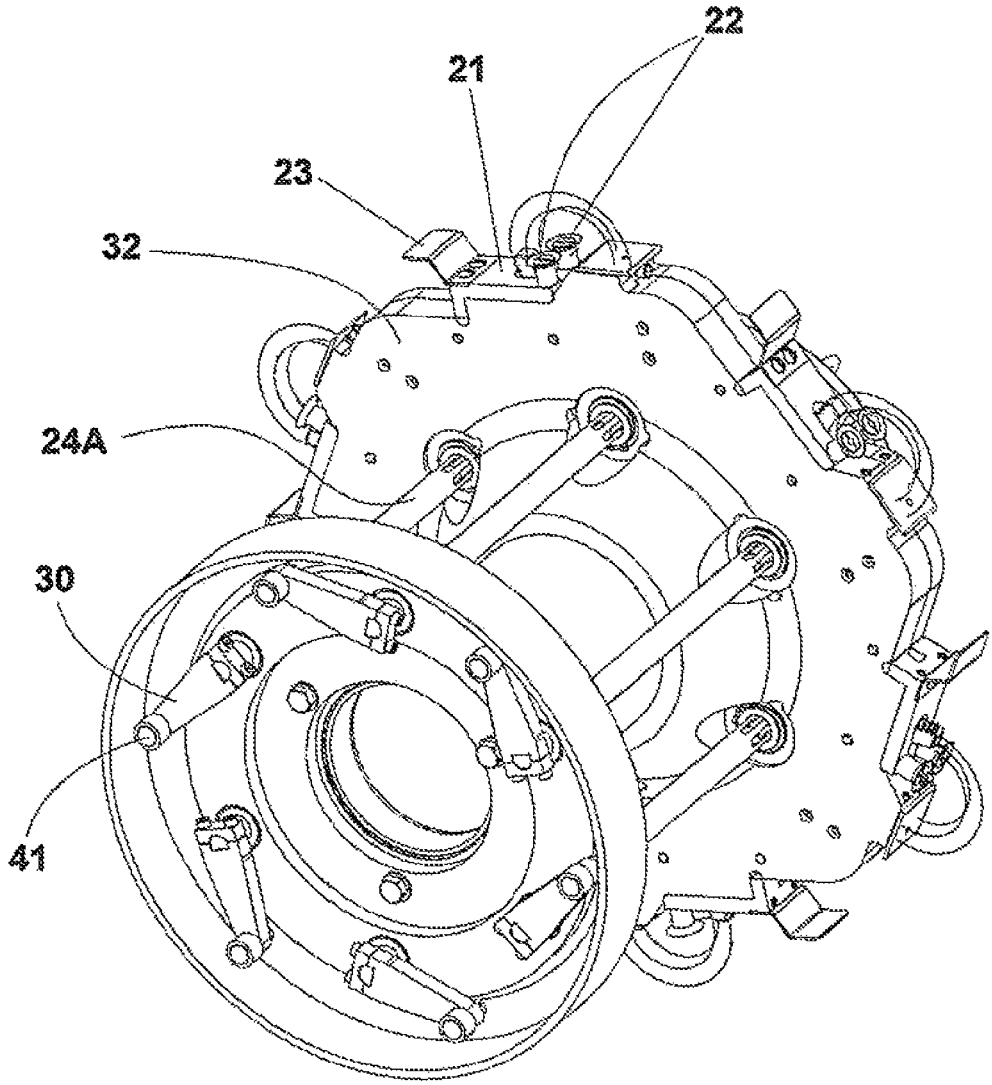
FIG. 12 is a perspective view highlighting the command means of the movement means of the folding means.

The folding means 29 cause the second flap 1B to rotate by at least 90°: in reality this angle is exceeded, as shown in FIG. 8 (position N), in order to prevent an elastic return of the scores 2A-2D when the action of the folding means ceases.

The folding means 29 and the flap 1B rotate about the axis C; there is, therefore, no relative velocity between the folding means and the second flap 1 B.

FIG. 8 shows that the first flap 1A goes to rest on the plate 23: this contributes to stabilizing the flap during the opening-out of the blank, consequent to the rotation of the second flap 1B with respect to the score 2A. The combined action of the retaining suckers 22 and the folding means 29 enables obtaining the tubular configuration 150 of the blank as shown in FIG. 6*a*; in this tubular configuration the blank is transferred to a packing machine 250 (denoted generally as it is not relevant to the invention) which folds the tabs 1F to define the bottom of a container, inserts articles internally of the container thus obtained and lastly closes the tabs 1F of the lid of the container.

In phase relation with the transfer of the blank 150 to the packing machine 250, the crown 27 oscillates in the inoperative direction R1 in order to return the folding means 29 into the position denoted with a continuous line in FIG. 8.

The invention claimed is:

1. A device for opening out blanks supplied in a flattened tubular configuration, the blanks withdrawn from a containing store (100) which contains a stack (P) of tubular blanks (1) in a flattened configuration, walls (100A, 100B) of the containing store (100) being mutually positioned for arranging a scoring line (2A) of each blank (1) connecting two external flaps (1A, 1 B) of the blank on a reference plane (7), the device comprising:

a first hooking device for hooking a first flap (1A) of the two external flaps (1A,1B) of a base blank of the stack (P) for a subsequent transfer of the blank to a corresponding work station (20) of a series of work stations (20) provided peripherally around a drum (300), set in constant rotation, said work stations (20) being angularly equidistanced from each other, each work station being provided with a retainer (22) for retaining the first flap (1A) and a folding device for folding a second flap (1 B) of the two external flaps, hinged to the first flap (1A) by the scoring line (2A), in a direction (R) opposite a direction (F) of rotation of the drum (300), the folding device (29) driven by a first activator to oscillate about an axis (C), parallel to an axis (11) of the drum (300), in the direction (R) opposite the rotation direction (F) of the drum (300);

wherein the first hooking device comprises two identical parallel arms (6A, 6B) borne by a shaft (8) for arranging the identical parallel arms (6A, 6B) bilaterally with respect to planes defined by heads of the drum (300), the identical parallel arms (6A, 6B) bearing aspirating grippers (12), the shaft (8) being rotatably supported by a bearing (9) from which the shaft (8) projects, the bearing (9) being borne by an arm (10) constrained to a bearing structure (70) of the device, the shaft (8) being adapted for oscillation with respect to the axis (11) of the drum (300), a second activator for rotating the shaft (8) with respect to a shaft axis for oscillating the identical parallel arms (6A, 6B) to define three positions for the aspirating grippers (12) borne by the identical parallel arms (6A, 6B):

a hooking position ($Y_1$) for hooking the first flap (1A) of the base blank (1) of the stack (P), a release position ($Y_3$) for releasing the blank on the retainer (22) of the corresponding work station (20)

and a further position ($Y_4$) located downstream of the release position, wherein the identical parallel arms (6A, 6B) of the first hooking device are borne by the shaft (8) and adapted to bear the aspirating grippers (12) so that, when the shaft (8) brings the aspirating grippers (12) to the hooking position ($Y_1$), a plane defined by axes of the aspirating grippers (12) is located at a distance (d) from said reference plane (7) where the scoring line (2A) of the blank is positioned;

wherein the retainers (22) of each work station (20) comprise a pair of retaining suckers (22) transversally flanked and located on a diameter plane of the drum (300) in a position so that the plane defined by the axes of the retaining suckers (22) is at a distance (d) from said axis (C), about which the folding device (29) oscillates, which corresponds and is equal to said distance (d) between the reference plane (7) and the plane identified by the axes of the aspirating grippers (12) of the hooking device;

wherein the shaft (8), by the oscillation of the arm (10), is made to oscillate alone an arc of circumference ($C_1$) that is concentric with the axis (11) of the drum (300) such that, when the shaft (8) brings the aspirating grippers (12) of the hooking device to the release position (Y3), the aspirating grippers (12) are arranged bilaterally and transversally aligned with the retaining suckers (22) of the corresponding work station (20) and the planes defined by the axes of the aspirating grippers (12) and by the axes of the retaining suckers (22) of the corresponding work station coincide so that the scoring line (2A) of the blank (1) is coaxial with said axis (C), the folding device (29), rotating about the axis (C), intercepting the second flap (1B) and folding the second flap (1B) with respect to the first flap (1A) by making the second flap (1B) rotate about said axis (C) without sliding across an external surface of the second flap (1B).

2. The device of claim 1, wherein the arm (10) is hinged to the structure (70) at an axis which is coaxial to the axis (11) of the drum (300), and further comprising a third activator moving the arm (10) in oscillation in an outward run ($I_1$), in a same direction as the rotation direction (F) of the drum (300), and in a return run ($I_2$), for defining, for the aspirating grippers (12) during the outward run in a timed interval centered on the release of the first flap (1A) by the aspirating grippers (12) and the hooking of the flap by the retaining suckers (22), a velocity which is equal to a peripheral velocity of the retainers (22).

3. The device of claim 1, wherein the first activator is constituted by a sector of a crown (27), an axis of the sector of the crown coinciding with said axis (C), a surface of the sector of the crown facing the axis (C) being abutted and guided by at least an idle roller (28), an axis of the idle roller (28) being parallel to the axis of the crown, a folder (29) being blocked at an end of the crown, which folder (29) faces internally and is orientated along a diameter plane of the crown, a transmission oscillating the crown in an operating direction (R) which is opposite the direction (F) of rotation of the drum (300), and a non-operating direction (R1) contrary to the operating direction.

4. The device of claim 3, wherein the transmission comprises a cogging provided externally on the sector of crown, which cogging enmeshes with a rotation mechanism activated in phase relation with the rotation of the drum.

5. The device of claim 4, wherein the rotation mechanism is constituted by a first cog wheel (26) enmeshing with the crown, a shaft on which a second cog wheel (25) is keyed, having a smaller diameter than the first cog wheel (26), which enmeshes with a cogged sector (24), a shaft (24A) for the cogged sector (24) projecting from a body (32) of the drum (300) bearing an arm (30), perpendicular to the shaft (24A), which idly supports a roller (41) engaging with a loop-wound fixed cam.

6. The device of claim 2, wherein the third activator is constituted by a roller (18) borne idly by the arm (10), engaging with a loop-wound cam provided on a disc (17) which rotates with respect to an axis parallel to the axis (11) of the drum (300).

7. The device of claim 2, wherein an upper part of the arm (10) is adapted to engage a fixed guide (19) moving in a circular arc having a center located on the oscillation axis of the arm (10).

8. The device of claim 6, wherein an upper part of the arm (10) is adapted to engage a fixed guide (19) moving in a circular arc having a center located on the oscillation axis of the arm (10).

9. The device of claim 1, wherein the second activator comprises a lever mechanism (12) connecting an end of the shaft (8) with an arm (15) hinged to the structure (70) of the device, a roller (16) being idly mounted on the arm, which roller (16) engages with a loop-wound cam provided on a disc (17) which rotates with respect to an axis parallel to the axis (11) of the drum (300).

10. The device of claim 1, wherein in each work station (20) upstream of the retaining suckers (22) with respect to the rotation direction (F) of the drum, a plate (23) is provided which defines a rest for the first flap (1A) hooked to the retaining suckers (22).

* * * * *